US009869112B2

(12) United States Patent
Jeon

(10) Patent No.: US 9,869,112 B2
(45) Date of Patent: Jan. 16, 2018

(54) REFRIGERATOR

(71) Applicant: LG ELECTRONICS INC., Seoul (KR)

(72) Inventor: Kibum Jeon, Seoul (KR)

(73) Assignee: LG Electronics Inc., Seoul (KR)

( * ) Notice: Subject to any disclaimer, the term of this patent is extended or adjusted under 35 U.S.C. 154(b) by 400 days.

(21) Appl. No.: 14/682,281

(22) Filed: Apr. 9, 2015

(65) Prior Publication Data

US 2015/0308158 A1 Oct. 29, 2015

(30) Foreign Application Priority Data

Apr. 28, 2014 (KR) ..... 10-2014-0050799

(51) Int. Cl.
*E05C 1/12* (2006.01)
*E05B 65/00* (2006.01)
(Continued)

(52) U.S. Cl.
CPC ..... *E05B 65/0042* (2013.01); *E05B 47/0607* (2013.01); *E05C 3/12* (2013.01);
(Continued)

(58) Field of Classification Search
CPC ..... F25D 23/025; E05B 65/0042; E05Y 2900/31; E05Y 2800/71
See application file for complete search history.

(56) References Cited

U.S. PATENT DOCUMENTS

2005/0144970 A1* 7/2005 Cho ..... E05C 19/028 62/441
2011/0315694 A1* 12/2011 Kurita ..... F25D 23/025 220/592.09

(Continued)

FOREIGN PATENT DOCUMENTS

CN 1637370 7/2005
CN 102695933 9/2012

(Continued)

OTHER PUBLICATIONS

Chinese Office Action in Chinese Application No. 201510205497.5, dated Dec. 30, 2016, 15 pages (with English translation).

(Continued)

*Primary Examiner* — Mark Williams
(74) *Attorney, Agent, or Firm* — Fish & Richardson P.C.

(57) ABSTRACT

A refrigerator includes a cabinet, a storage compartment within the cabinet, a main door to open or close the storage compartment, an auxiliary storage compartment mounted to a rear surface of the main door and configured to be accessed through an opening in the main door, a sub door to open or close the opening leading to the auxiliary storage compartment, a hook member at the sub door, a latch cam pivotally mounted in the main door to be selectively caught by the hook member, a stopper pivotally mounted at a location above the latch cam to selectively limit pivotal rotation of the latch cam, a solenoid device mounted below the latch cam to laterally push the stopper via a vertical movement caused by the solenoid device to release locking between the stopper and the latch cam, and a controller provided at the sub door to selectively operate the solenoid device.

18 Claims, 17 Drawing Sheets

(51) Int. Cl.

| | |
|---|---|
| ***F25D 23/02*** | (2006.01) |
| ***E05C 3/12*** | (2006.01) |
| ***E05B 47/06*** | (2006.01) |
| ***E05C 3/24*** | (2006.01) |
| *E05C 7/02* | (2006.01) |
| *E05F 1/12* | (2006.01) |

(52) U.S. Cl.
CPC ..... *E05C 3/24* (2013.01); *F25D 23/02* (2013.01); *F25D 23/025* (2013.01); *F25D 23/028* (2013.01); *E05C 7/02* (2013.01); *E05F 1/1223* (2013.01); *E05Y 2900/31* (2013.01)

(56) References Cited

U.S. PATENT DOCUMENTS

| | | | | |
|---|---|---|---|---|
| 2013/0026900 | A1 | 1/2013 | Oh | |
| 2014/0009055 | A1 | 1/2014 | Cho et al. | |
| 2014/0203695 | A1 | 7/2014 | Oh | |
| 2014/0265378 | A1* | 9/2014 | Lee | D06F 39/14 292/341.17 |

FOREIGN PATENT DOCUMENTS

| | | | | |
|---|---|---|---|---|
| JP | 04323478 | A | * | 11/1992 |
| KR | 2013028839 | B1 | | 3/2013 |
| KR | 10-1347002 | B1 | | 1/2014 |
| WO | WO 2011/081279 | A1 | | 7/2011 |

OTHER PUBLICATIONS

European Search Report dated Aug. 28, 2015 from corresponding European Patent Application No. 15161084.7, 4 pages.

* cited by examiner

REFRIGERATOR

This application claims the benefit of Korean Patent Application No. 10-2014-0050799, filed on, Apr. 28, 2014, which is hereby incorporated by reference as if fully set forth herein.

TECHNICAL FIELD

The present application relates to a refrigerator and, more particularly, to a refrigerator which is capable of selectively releasing a coupled state between a main door and a sub door.

BACKGROUND

In general, refrigerators are apparatuses that keep food at freezing or less or at a temperature slightly above freezing by discharging cold air generated by a refrigeration cycle consisting of, for example, a compressor, a condenser, an expansion valve, and an evaporator to lower a temperature in a storage compartment thereof.

A typical refrigerator includes a freezing compartment in which foods or beverages are kept frozen and a refrigerating compartment in which foods or beverages are kept cold.

There are several kinds of refrigerators including a top mounting type refrigerator in which a freezing compartment is located above a refrigerating compartment, a bottom freezer type refrigerator in which a freezing compartment is located below a refrigerating compartment, and a side by side type refrigerator in which a freezing compartment and a refrigerating compartment are divided into left and right sides.

Recently, in addition to an original function of keeping foods refrigerated or frozen, functions of a refrigerator are being diversified. For example, a dispenser is installed to a door of the refrigerator to provide purified water and ice, and a display is installed to a front surface of the door to show a state of the refrigerator and to assist a user in controlling the refrigerator.

In addition, the capacity of the refrigerator tends to increase and, for efficient utilization of a receiving space, door shelves and receiving cases are affixed to an inner surface of the door to define spaces for receiving storage items.

More particularly, a refrigerating compartment door sometimes includes a main door to open or close a storage compartment, and a sub door pivotally mounted to the main door to assist the user in accessing an auxiliary storage chamber inside the main door through an opening formed in the main door.

In some cases, the sub door is selectively coupled to the main door as a hook member formed at a rear surface of the sub door is coupled to a latch device formed at the main door. When a user pulls a handle provided at the sub door, both the sub door and the main door coupled to each other are opened, so the user can access an open refrigerating compartment. A coupled state of the hook member and the latch device is released as the user pushes a latch release button formed at a front surface of the auxiliary door.

The latch release button penetrates the sub door to operate a latch release device that serves to release a locked state of the latch device.

FIGS. 1 and 2 are partial sectional views illustrating a main door and a sub door provided respectively with a latch device and a latch release device according to the related art as disclosed in Korean Patent Registration Publication No. 10-1347002, filed and registered by the applicant of the present application.

As exemplarily illustrated in FIG. 1, a locking unit to selectively couple the main door and the sub door 340 to each other includes a locking device mounted to the main door and a hook member 341 provided at the sub door 340.

In addition, a latch slot is formed in a front surface of the main door to which the locking device is mounted.

The locking device includes a locking assembly 610 mounted in a locking device mounting recess formed in the sub door 340 and a locking device cover 620 to shield the locking device mounting recess.

One end of the locking assembly 610 is caught by and trapped in the locking device mounting recess and the other end is fastened to the locking device mounting recess by screws.

In addition, a latch rod 615 is mounted to the locking assembly 610 and adapted to be pushed by a push rod 633 of an opening unit. The latch rod 615 is elastically supported by an elastic member 617, such as a spring, inside the locking assembly 610.

The hook member 341 constituting the locking unit is fastened to a rear surface of the sub door 340 by screws. In addition, the locking device constituting the locking unit is located at the front surface of the main door at a position corresponding to the hook member 341.

The opening unit is provided at one side of the sub door 340 at a position corresponding to the locking device and corresponds to a release means to release a locked state of the locking unit. The opening unit is adapted to be moved forward and rearward via user operation, thereby serving to release coupling between the locking device and the hook member 341. The opening unit is configured to be exposed from the front surface of the sub door 340. Accordingly, when the user operates the opening unit through the front surface of the sub door 340, coupling between the locking device and the hook member 341 is released, causing the sub door 340 to be opened.

The opening unit includes an operating button 632 that is mounted in the sub door 340 so as to be movable forward and rearward and operated by being pushed by the user and the push rod 633 that pushes the latch rod 615 by being moved forward and rearward as the operating button 632 is operated.

The locking assembly 610 includes a latch cam 612 rotatably mounted in a case to selectively trap the hook member 341, a stopper 613 to selectively limit rotation of the latch cam 612, and the latch rod 615 to push the stopper 613 rearward so as to allow the latch cam 612 to be rotatable.

A rod mounting portion 616 is formed in front of the stopper 613 and the latch rod 615 is forwardly and rearwardly movably mounted in the rod mounting portion 616. The rod mounting portion 616 is formed at a position corresponding to a position of the push rod 633.

The latch rod 615 is supported by the elastic member 617 such as a spring so as to be returned to an original position thereof by elasticity of the elastic member 617 when external force applied thereto is removed after rearward movement of the latch rod 615.

When the user pushes the operating button 632, a rear end of the push rod 633 applies pressure to a front end of the latch rod 615 to move the latch rod 615 rearward, thus causing the latch rod 615 to push the stopper 613. As the stopper 613 is pushed rearward, the stopper 613 is separated from a trap portion of the latch cam 612. Simultaneously, the latch cam 612 is rotated forward by elasticity of a torsion spring provided at the latch cam 612 so as to be separable from the hook member 341.

Referring to FIG. 2, the operating button 632, the push rod 633 and the latch rod 615, used to push the stopper 613 as illustrated in FIG. 1, are replaced with an actuator member 618 such as a solenoid and an input member 640.

An electric wire 642 extended from the input member 640 passes through an electric wire 619 by way of a controller to thereby be connected to the actuator 618.

That is, when the user touches the input member 640 or applies pressure to the input member 640, a corresponding signal is transmitted to the controller, and the controller operates the actuator 618 to push the stopper 613.

In the two above-described examples, both the latch rod 615 and the actuator 618 are arranged below the latch cam 612 and in front of the stopper 613 so as to push the stopper 613 rearward and pivotally rotate the same.

However, only one of the button operation structure and the solenoid operation structure may be applied as the latch release device and the button operation structure and the solenoid operation structure cannot be provided together. That is, the user cannot selectively operate a mechanical or electronic latch release device on a single door.

This is because the latch rod 615 and the actuator 618 must be accommodated in the case of the locking assembly 610 at a position below the latch cam 612 and in front of the stopper 613, and both the latch rod 615 and the actuator 618 may not be mounted at the same position.

In addition, because the latch rod 615 and the actuator 618 are operated to push the stopper 613 forward and rearward, a considerable increase in the thickness of the latch release device may result.

SUMMARY

Accordingly, an object of the present application is to provide a dual door type refrigerator which is capable of selectively releasing a coupled state between a main door and a sub door in a mechanical manner and an electronic manner.

Additional advantages, objects, and features will be set forth in part in the description which follows and in part will become apparent to those having ordinary skill in the art upon examination of the following or may be learned from practice. The objectives and other advantages may be realized and attained by the structure particularly pointed out in the written description and claims hereof as well as the appended drawings.

According to one aspect, a refrigerator includes a cabinet, a storage compartment defined within the cabinet, a main door pivotally mounted to the cabinet and configured to open or close at least a portion of the storage compartment, an auxiliary storage compartment mounted to a rear surface of the main door, the auxiliary storage compartment being configured to be accessed through an opening in the main door, a sub door pivotally mounted to the main door and configured to open or close at least a portion of the opening leading to the auxiliary storage compartment, a hook member provided at the sub door, a latch cam pivotally mounted in the main door and configured to be selectively caught by the hook member, a stopper pivotally mounted at a location above the latch cam and configured to selectively limit pivotal rotation of the latch cam, a solenoid device mounted below the latch cam and configured to laterally push the stopper via a vertical movement caused by the solenoid device to thereby release locking between the stopper and the latch cam, and a controller provided at the sub door to selectively operate the solenoid device.

Implementations according to this aspect may include or more of the following features. For example, the solenoid device may include a main body configured to be operated via application of electric power, a rod mounted to the main body and configured to move in a vertical direction, and a head member coupled to an end of the rod and configured to selectively push a lateral surface of the stopper. The rod and head member may be configured, based on being upwardly moved, to be lowered by weights thereof to return to original positions thereof when electric power is interrupted after operation of the solenoid device. The stopper may have at least one inclined lateral surface, and the head member may include a groove configured to laterally push the stopper while moving upward in contact with the inclined lateral surface of the stopper. The latch cam may include a latching protrusion formed at an outer circumferential surface of the latch cam and configured to be caught by a bent end of the stopper, and a lateral support portion protruding from a lateral end of the latching protrusion and configured to support a lateral surface of the latching protrusion. The latch cam may have an open side opposite to the lateral support portion such that the stopper is configured to be released from the latching protrusion by being pivoted based on the head member laterally pushing the stopper. The latch cam may include a slope configured to guide the bent end of the stopper so as to allow the bent end to be caught by the latching protrusion based on the latch cam that has been released from the stopper again being locked with the stopper.

The refrigerator according to this aspect may include an operating button provided at the sub door and configured to be pushed by a user, a push rod located at a rear side of the operating button and configured to be horizontally moved along with the operating button, and a latch rod mounted in the main door and configured to push the stopper by being horizontally moved by the push rod. The refrigerator may further include a first elastic member connected to the stopper and configured to apply force for rotating the stopper in a direction crossing a movement direction of the latch rod. The refrigerator may further include a second elastic member connected to the latch cam and configured to apply force for rotating the latch cam based on the latch cam being released from the stopper. The second elastic member may be a torsion spring mounted to a rotating shaft of the latch cam. The latch cam, the stopper, the first elastic member, and the second elastic member may be mounted in a latch case. The latch case may be provided with an elastic cover member that is configured to allow rearward pivotal rotation of the stopper. The controller may be a touch sensor device configured to be operated by user touch. The controller may be a voice recognition device configured to be operated by user voice. The refrigerator according to this aspect may include a hinge bracket configured to pivotally couple one end of the sub door to the main door, and a hinge assembly configured to pivotally connect one end of the sub door to the hinge bracket, the hinge assembly being configured to apply elastic force in an opening direction of the sub door. The hinge assembly may include hinge fixing portion fixed to the hinge bracket, the hinge fixing portion having a first cam at an upper surface thereof, a hinge rotating portion at the sub door, the hinge rotating portion having a second cam at a lower surface thereof, the second cam being engaged with the first cam, and an elastic member mounted to one side of the hinge rotating portion to provide elastic force for pushing the hinge rotating portion to the hinge fixing portion.

It is to be understood that both the foregoing general description and the following detailed description of the present application are exemplary and explanatory and are intended to provide further explanation of the present application as claimed.

DETAILED DESCRIPTION

Hereinafter, exemplary implementations of the present application will be described in detail with reference to the accompanying drawings.

Figure 3:
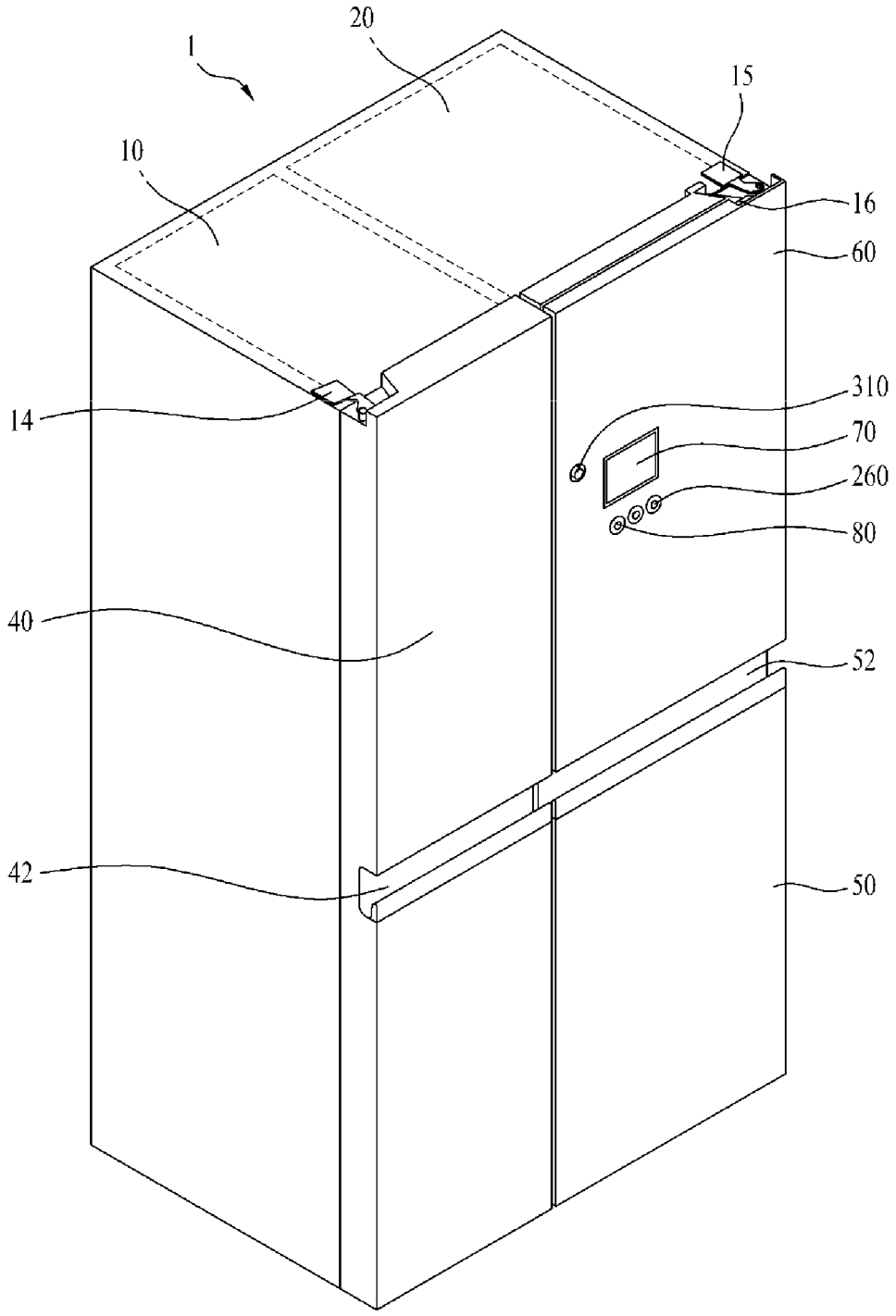
FIG. 3 is a perspective view showing an example refrigerator according to the present application.
Figure 4:
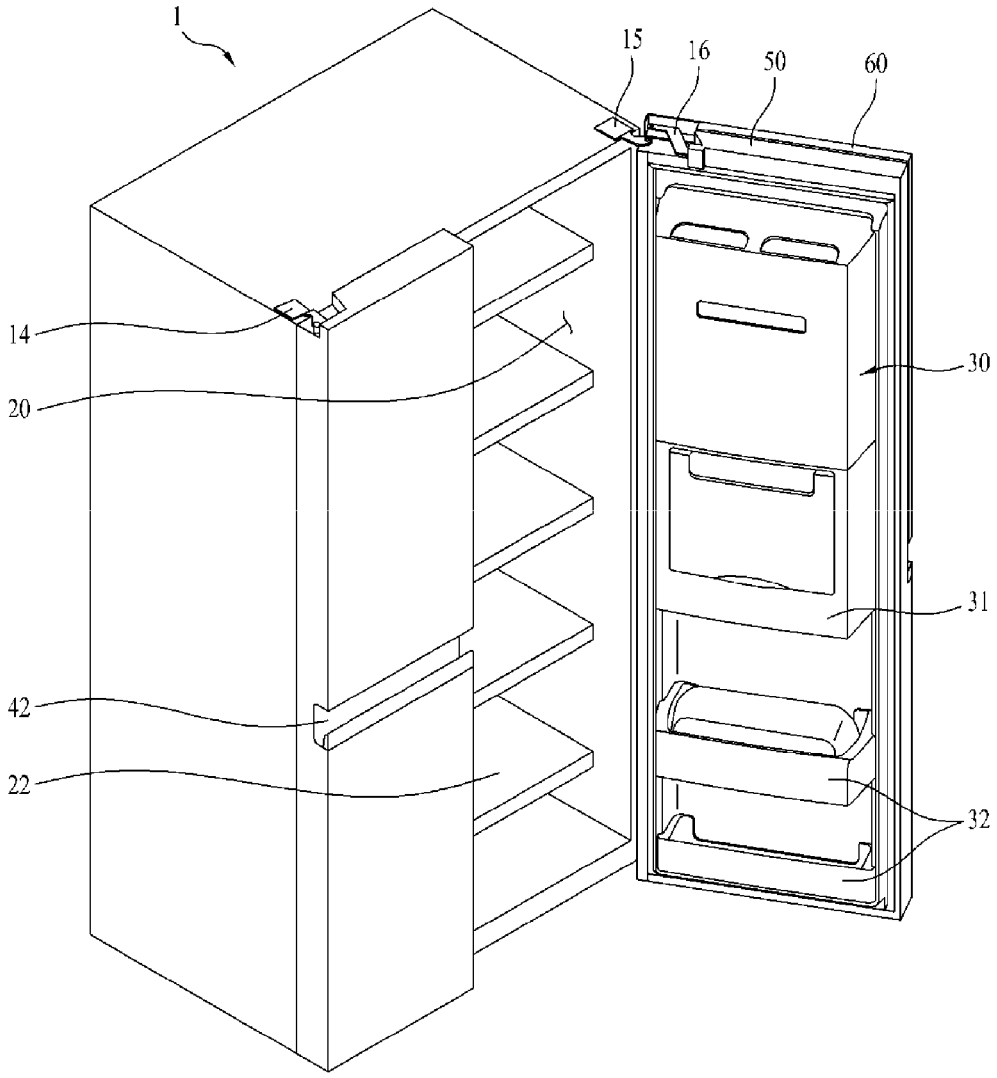
FIG. 4 is a perspective view showing an opened state of a refrigerating compartment door included in the refrigerator of FIG. 3.
Figure 5:
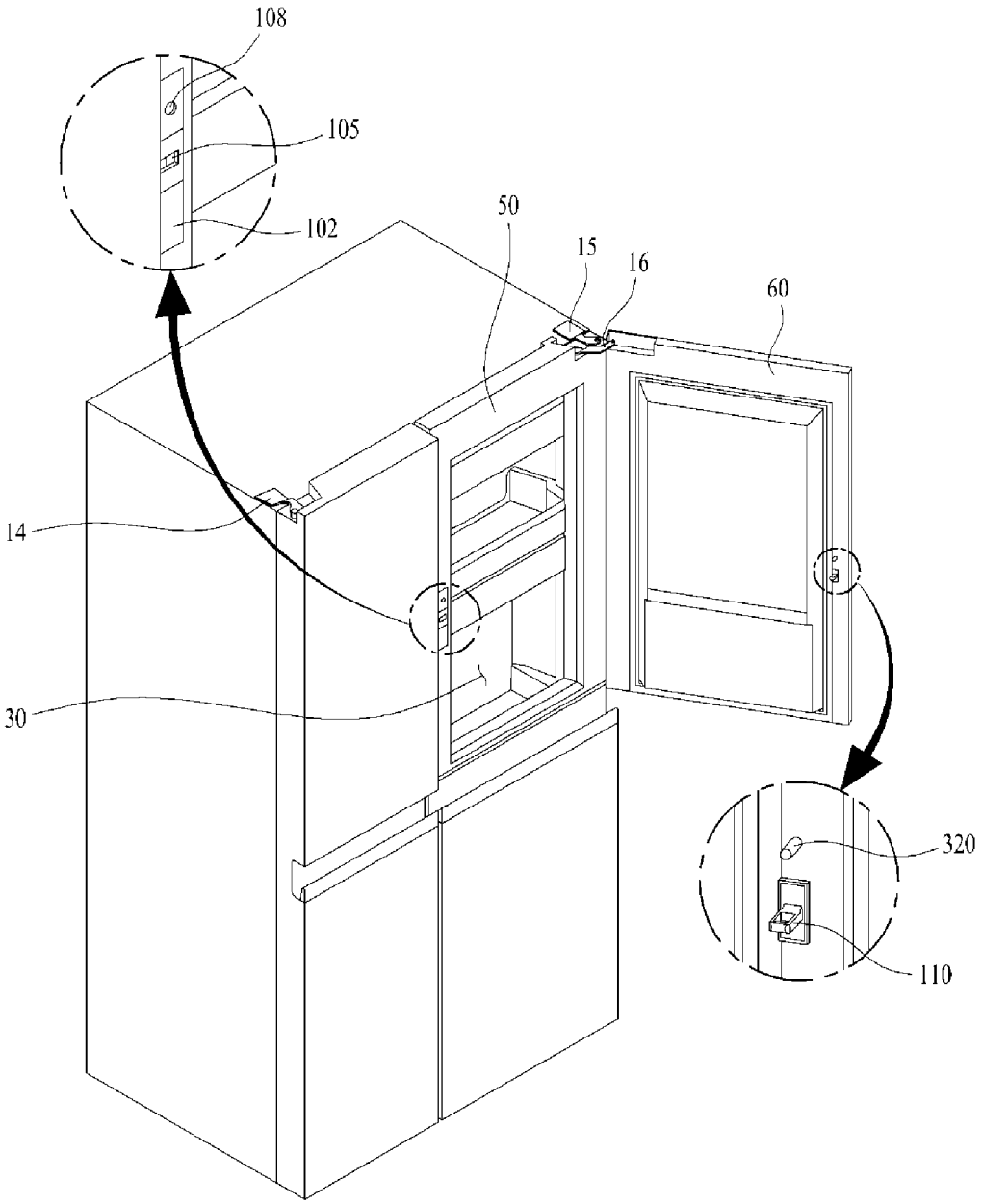
FIG. 5 is a perspective view showing an opened state of a sub door mounted to the refrigerating compartment door included in the refrigerator of FIG. 3.

Referring to FIGS. 3 to 5, the present application may be applied to a side by side type refrigerator in which a freezing compartment 10 and a refrigerating compartment 20 are defined respectively in the left and right sides of a main body 1.

However, it will be appreciated that the present application is not limited to this type of refrigerator and may be applied to other types of refrigerators such as, for example, a top mounting type or bottom freezer type refrigerator so long as the refrigerator includes double doors to open or close storage compartments of the refrigerator.

As illustrated, a freezing compartment door 40 to open or close the freezing compartment 10 and a refrigerating compartment door 50 to open or close the refrigerating compartment 20 are pivotally mounted to opposite sides of the main body 1 respectively.

To this end, a pair of hinges 14 and 15 is mounted to both sides of each of an upper surface and a lower surface of the main body 1 and the freezing compartment door 40 and the refrigerating compartment door 50 are respectively coupled to the hinges 14 and 15.

The freezing compartment door 40 and the refrigerating compartment door 50 may be provided at middle portions thereof with grip grooves 42 and 52 to assist the user in gripping and pulling the doors 40 and 50 upon opening of the doors 40 and 50. Alternatively, grippers may vertically or horizontally protrude from front surfaces of the doors 40 and 50.

A sub door 60 may be pivotally mounted to the refrigerating compartment door 50 via a second hinge 16. The refrigerating compartment door 50 may be referred to as a main door 50 under provision of the sub door 60.

While the sub door 60 may be located at an upper portion of the refrigerating compartment door 50, the sub door 60 may have the same size as the refrigerating compartment door 50, or the sub door 60 having a smaller width and height than those of the refrigerating compartment door 50 may be located at a middle portion or another position of the refrigerating compartment door 50.

A display 70 may be installed to a front surface of the sub door 60 to display a still image or a moving image. A plurality of operating buttons 80 may be arranged below the display 70 to allow the user to operate the display 70.

A controller 260 may be installed below the display 70 and used to operate a solenoid device that will be described below.

In addition, an operating button 310 may be provided at the front surface of the sub door 60 at a position opposite to the second hinge 16 and used to mechanically operate a latch release device.

As exemplarily illustrated in FIG. 4, when the user opens the refrigerating compartment door 50 as the main door, the user can access the refrigerating compartment 20 in which a plurality of shelves 22 is arranged. In addition to the shelves 20, one or more drawers may be installed in the refrigerating compartment 20.

An auxiliary storage chamber 30 may be mounted to a rear surface of the main door 50. In this case, when the user opens the sub door 60, the user can access the auxiliary storage chamber 30 through an opening formed in the main door 50.

The auxiliary storage chamber 30 may have at least one vent hole to enable introduction of cold air from the refrigerating compartment 20, or may have an opening to allow the user who opens the main door 50 to access the auxiliary storage chamber 30 from the inside.

In addition, the auxiliary storage chamber 30, as illustrated, may be provided with a second auxiliary storage chamber 31. That is, the auxiliary storage chamber 30 may be divided into a plurality of storage chambers.

One or more baskets 32 may be mounted to the rear surface of the main door 50 at positions below the auxiliary storage chamber 30. One or more baskets may also be mounted to the auxiliary storage chamber 30.

As exemplarily illustrated in FIG. 5, when the user opens the sub door 60 while the main door 50 is in a closed state, the user can access the auxiliary storage chamber 30 through the opening formed in the main door 50 as described above.

Further referring to FIG. 5, a hook member 110 protrudes from one side of a rear surface of the sub door 60, and a latch slot 105 is formed in one side of a front surface of the main door 50 at a position corresponding to the hook member 110. As such, the hook member 110 may be inserted into and coupled to the latch slot 105.

A latch cam 120 that will be described below is mounted in the latch slot 105 so as to be selectively coupled to the hook member 110.

The latch slot 105 may be formed in a front surface of a latch case 102 that will be described below. That is, the main door 50 may have a recess for installation of a latch device formed in one side thereof, and the latch case 102 may be mounted in the recess such that a front surface of the latch case 102 flushes with the front surface of the main door 50.

In addition, a push rod 320 may protrude at a position immediately above the hook member 110. The push rod 320 is adapted to be moved along with the operating button 310 and functions to push a latch rod 330 that will be described below.

The latch case 102 has a through-hole formed in the front surface thereof at a position corresponding to the push rod 320. The latch rod 330 is mounted in the through-hole so as to be selectively pushed by the push rod 320.

Now, referring to FIGS. 6-9, descriptions will be given of an example configuration and operation relationship of a latch device 100.

Elements of the latch device 100 are mounted in the main door 50. All of the elements may be mounted in the rectangular latch case 102.

Generally, an insulation material is injected into the main door 50. Injection of this insulation material may be performed after the latch device 100 assembled with the case 102 is fastened to the main door 50.

The case 102 may be inserted into a vertically elongated hole formed in the front surface of the main door 50 and fastened using screws. Left and right lateral portions of the case 102 may be fixedly screwed and a cover unit may be coupled to the latch case 102.

The latch cam 120 is mounted between both lateral surfaces of the case 102 such that a pivot shaft thereof extends in a left-and-right direction. The latch cam 120 may include a first extension portion 124 and a second extension portion 126 as downwardly extending portions. The first extension portion 124 is configured to be selectively caught by and secured to the hook member 110, and the second extension portion 126 is configured to be pushed and pivoted by the hook member 110.

The first extension portion 124 and the second extension portion 126 may define a gap 125 therebetween for receiving one end of the hook member 110. The second extension portion 126 may be longer than the first extension portion 124, so as to be pushed and pivoted by the hook member 110 in a pivoted state of the latch cam 120.

A stopper 130 is pivotally mounted above the latch cam 120 and serves to selectively limit pivotal rotation of the latch cam 120. The stopper 130 is mounted in the case 102 such that a pivot shaft 133 thereof extends in a front-and-rear direction.

The stopper 130 is provided at an upper end thereof with a through-hole 132 for insertion of the pivot shaft 133. The through-hole 132 has a greater diameter than a diameter of the pivot shaft 133. As such, the stopper 130 may be pivoted in a left-and-right direction as well as in an up-and-down direction about the pivot shaft 133.

The latch cam 120 may be provided at an outer circumferential surface thereof with a latching protrusion 122. The latching protrusion 122 is configured to be selectively caught by a bent end 135 formed at a lower end of the stopper 130.

The latching protrusion 122 may be shaped in such a manner that one side thereof is closed and the other side thereof is open. An upper surface of the latching protrusion 122 may take the form of a slope 123 inclined downward to the open side of the latching protrusion 122.

A solenoid device 200 is mounted below the latch cam 120 to release locking between the stopper 130 and the latch cam 120 by laterally pushing the stopper 130. The solenoid device 200 includes a rod that is vertically movable by electromagnetic force. The solenoid device 200 may laterally push the stopper 130 to pivotally rotate the stopper 130 in a left-and-right direction. The solenoid device 200 is moved to cause a protruding operation of the rod upon receiving power applied thereto. To this end, the controller 260 is installed to the sub door 60 to control application of power to the solenoid device 200.

The controller 260 serves as an input unit that is operated by the user to operate the solenoid device 200. The controller 260 may take the form of a mechanical push button, a touch button having a touch sensor, or a voice recognition device that recognizes a voice command of the user and determines whether the recognized voice command is a command to operate the solenoid device 200.

Figure 2:
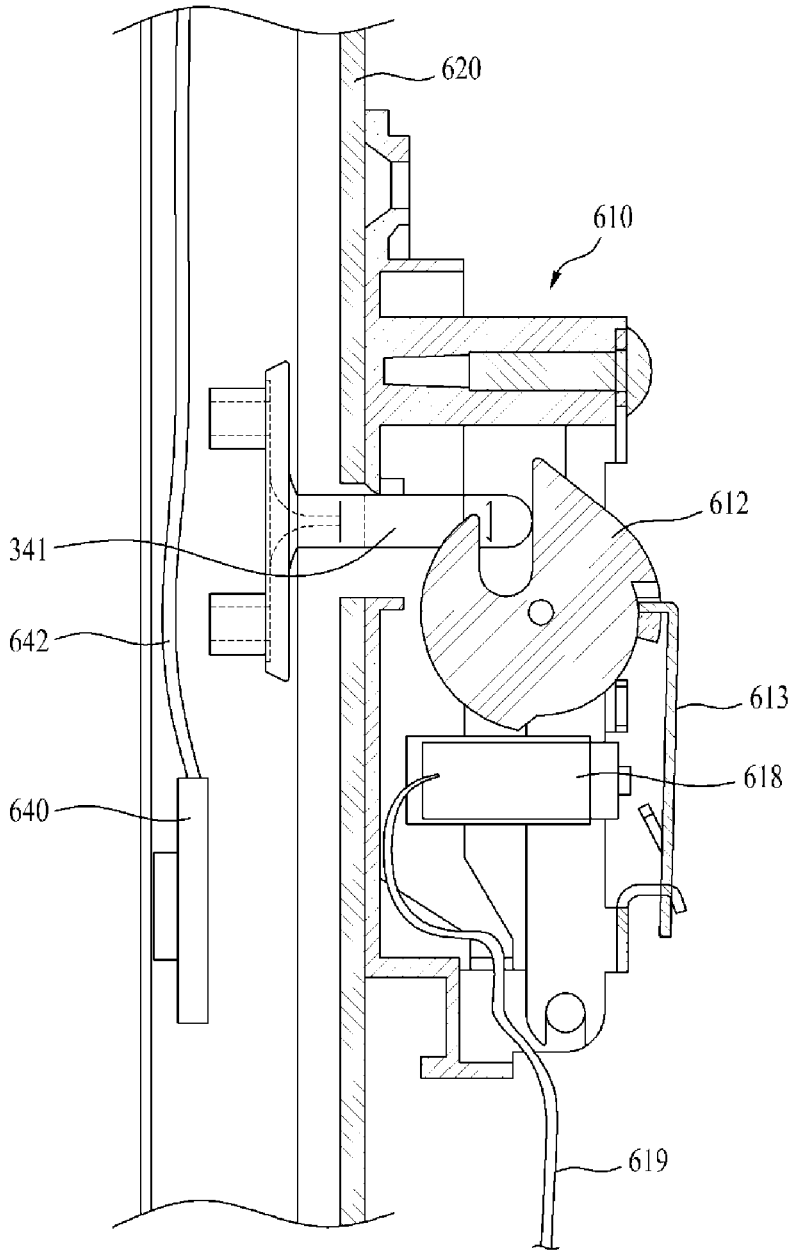
FIG. 2 PRIOR ART
FIG. 2 is a partial sectional view illustrating a prior art electronic latch release device.

The solenoid device 200 may include a main body 220 to be operated upon receiving power applied thereto, a rod 230 vertically movably mounted to the main body 220, and a head member 250 coupled to an end of the rod 230 to selectively push a lateral surface of the stopper 130. A coil is wound inside the main body 220 to generate electromagnetic force when current flows therein and the rod 230 is vertically movably mounted inside the coil. Both ends of the coil may be connected to power terminals exposed outside of the main body 220 and thus may be connected to electric wires 619 (see FIG. 2). The rod 230 may be formed of a metal and have a cylindrical shape. An upper portion of the rod 230 may protrude upward from the main body 220.

When current flows in a given direction in the coil of the main body 220, the rod 230 may move upward. When current flows in an opposite direction, the rod 230 may move downward.

The head member 250 is coupled to an upper end of the rod 230 to selectively push the lateral surface of the stopper 130. The head member 250 may have a coupling bore 243 such that the upper end of the rod 230 is inserted into the coupling bore 243 to achieve coupling between the head member 250 and the rod 230. The coupling bore 243 may be formed in a coupling portion 240 of the head member 250.

Figure 7:
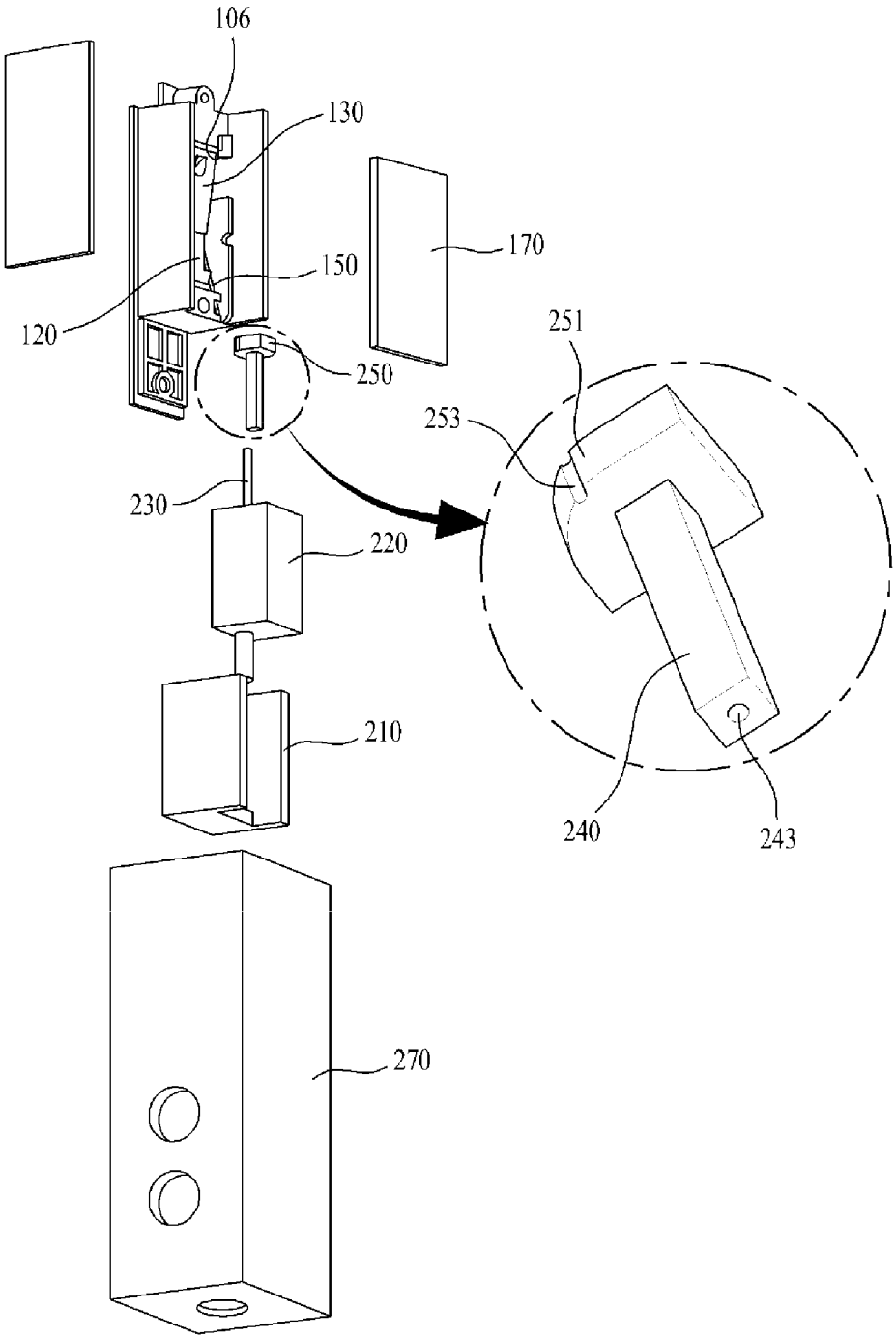
FIG. 7 is an exploded perspective view showing a case cover and the latch release device of FIG. 6.

The coupling portion 240, as exemplarily illustrated in the enlarged view of FIG. 7, may take the form of a square column integrally formed with the head member 250 and may be formed of a plastic material. Owing to the square column shape of the coupling portion 240, the rod 230 and the head member 250 may be coupled to each other with a preset assembly angle therebetween. The head member 250 is located to laterally push the stopper 130 via upward movement thereof.

The solenoid device 200 may be configured in such a manner that the upwardly moved rod 230 and head member 250 may be lowered by weights thereof so as to return to original positions thereof when power is interrupted after the solenoid device 200 was operated to release a locked state of the latch device 100. The rod 230 is mounted perpendicular to the ground surface and gravity is applied downward to the rod 230.

Accordingly, the rod 230 coupled to the head member 250 may automatically move downward so as to return to an original position thereof when supply of power to the solenoid device 200 stops. Hence, there is no need to flow current in an opposite direction through the solenoid device 200 or to provide a separate elastic member, in order to return the rod 230 to an original position thereof.

On the basis of illustrations in FIG. 7, a right lateral surface of the stopper 130 selectively coming into contact with one side of the head member 250 may be inclined. Through this shape, the stopper 130 may be pivoted leftward via upward movement of the head member 250.

In addition, a left lateral surface of the head member 250 may have an inclined rear portion to form a slope 251. A groove 253 may be formed in the slope 251 to allow a right-side edge of the stopper 130 to be inserted therein. Although the slope 251 may have a flat surface, the slope 261 may have a curved surface.

The slope 251 having a curved surface may smoothly guide insertion of the right-side edge of the stopper 130 into the groove 253 of the head member 250 as the head member 250 is moved upward.

In addition, a left lateral surface of the stopper 130 may be inclined. In this way, when the stopper 130 is laterally pushed and pivoted by the head member 250, the stopper 130 may have no risk of reduction in pivotal rotation angle thereof due to interference between the stopper 130 and an inner surface of the case 120.

The latch cam 120 may include the latching protrusion 122 formed at the outer circumferential surface thereof so as to be caught by the bent end 135 of the stopper 130 and a lateral support portion 122S protruding from a lateral end of the latching protrusion 122 to support a lateral surface of the latching protrusion 122.

The lower end 135 of the stopper 130 may be bent toward the outer circumferential surface of the latch cam 120. The bent end 135 serves to limit pivotal rotation of the latch cam 120 by being selectively caught by the latching protrusion 122 formed at the outer circumferential surface of the latch cam 120.

The latching protrusion 122 protrudes from the outer circumferential surface of the latch cam 120 so as to be caught by the bent end 135. The lateral support portion 122S may protrude from a right-side end of the latching protrusion 122 when viewing the latch cam 120 from the front side.

Once the bent end 135 of the stopper 130 is caught by the latching protrusion 122 of the latch cam 120, the lateral support portion 122S may allow only leftward pivotal rotation of the latch cam 120 while preventing rightward pivotal rotation of the latch cam 120.

In addition, the latching protrusion 122 may have an open side opposite to the lateral support portion 122S to allow the stopper 130 to be pivoted and released from the latching protrusion 122 when the head member 250 laterally pushes the stopper 130.

The stopper 130 may be pivoted leftward as the head member 250 is moved upward to push the stopper 130. At this time, the bent end 135 is separated from the latching protrusion 122 through the open side of the latching protrusion 122, thereby releasing a locked state of the latch cam 120 and enabling pivotal rotation of the latch cam 120.

The latch cam 120 may further include the slope 123 to guide the bent end 135 of the stopper 130 such that the bent end 135 of the stopper 130 is caught by the latching protrusion 122 when the latch cam 120 separated from the stopper 130 is again locked with the stopper 130. The slope 123 defining the upper surface of the latching protrusion 122 may be inclined downward to the open left side of the latching protrusion 122.

Accordingly, when the head member 250 moves downward after the latch cam 120 is pivoted as the stopper 130 was unlocked from the latch cam 120 by being pushed by the head member 250, the stopper 130 is pivoted rightward to return to an original position thereof by a first elastic member 140 that will be described below.

In such a state, when the hook member 110 pushes the second extension portion 126 behind the gap 125 of the latch cam 120 so as to pivotally rotate the latch cam 120, the bent end 135 is first pivoted leftward under guidance of the slope 123 and then moved rightward through the open left side of the latching protrusion 122 so as to be caught by the latching protrusion 122.

The refrigerator of the present application may include elements to mechanically release a locked state of the latch device 100, and these elements include the operating button 310 provided at the sub door 60 so as to be pushed by the user, the push rod 320 located at the rear of the operating button 310 so as to be horizontally moved along with the operating button 310, and the latch rod 330 mounted in the main door 50 so as to be horizontally moved by the push rod 320 to push the stopper 130.

As described above with reference to FIG. 3, the operating button 310 may be mounted in a through-hole formed in one side of the sub door 60 so as to be exposed from the front surface of the sub door 60.

As exemplarily illustrated in FIG. 5, the push rod 320 coupled to a rear end of the operating button 310 penetrates the sub door 60 so as to protrude from the rear surface of the sub door 60.

Figure 1:
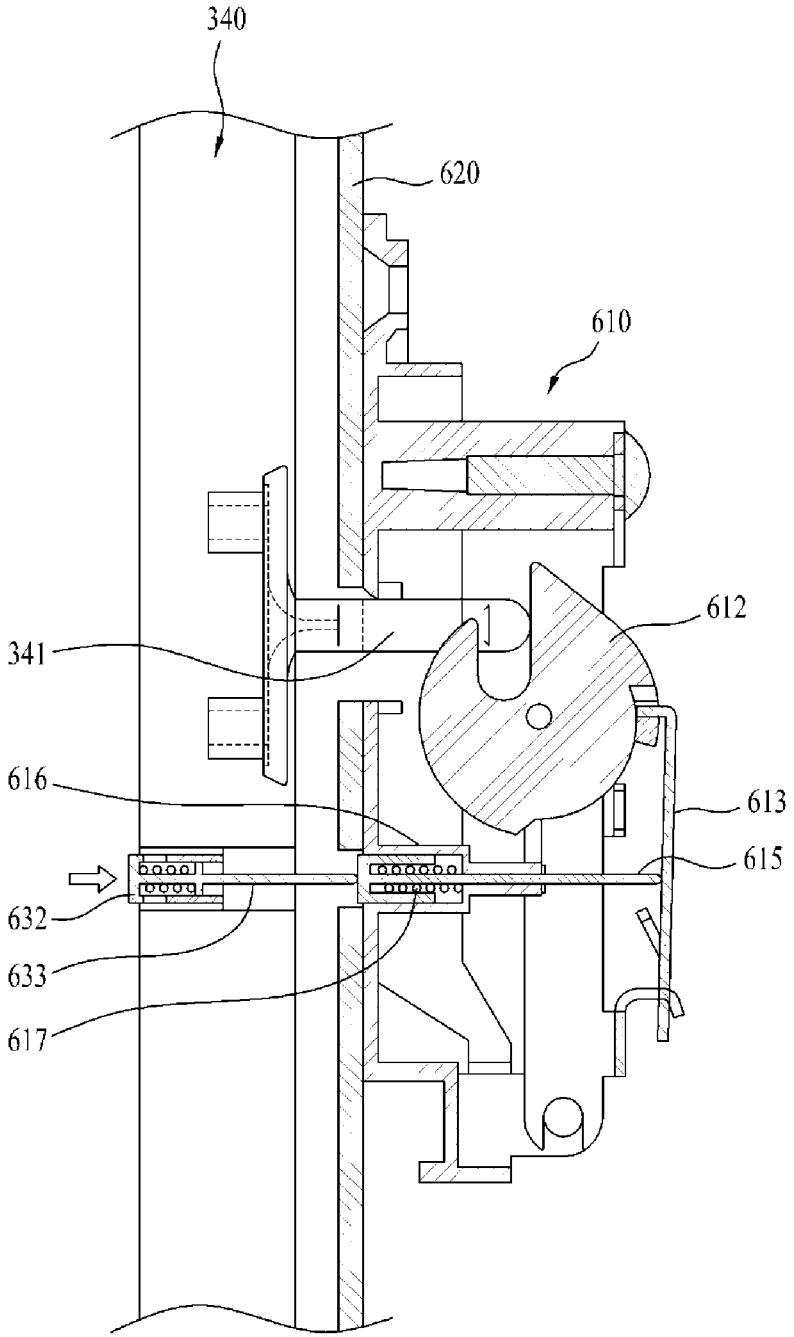
FIG. 1 PRIOR ART
FIG. 1 is a partial sectional view illustrating a prior art mechanical latch release device.

The push rod 320 is adapted to be moved along with the operating button 310 and an elastic member is mounted in the sub door 60 as exemplarily illustrated in FIG. 1. Accordingly, when push force applied to the operating button 310 is removed, the operating button 310 and the push rod 320 may be moved forward to return to their original positions thereof by the elastic member.

Figure 8:
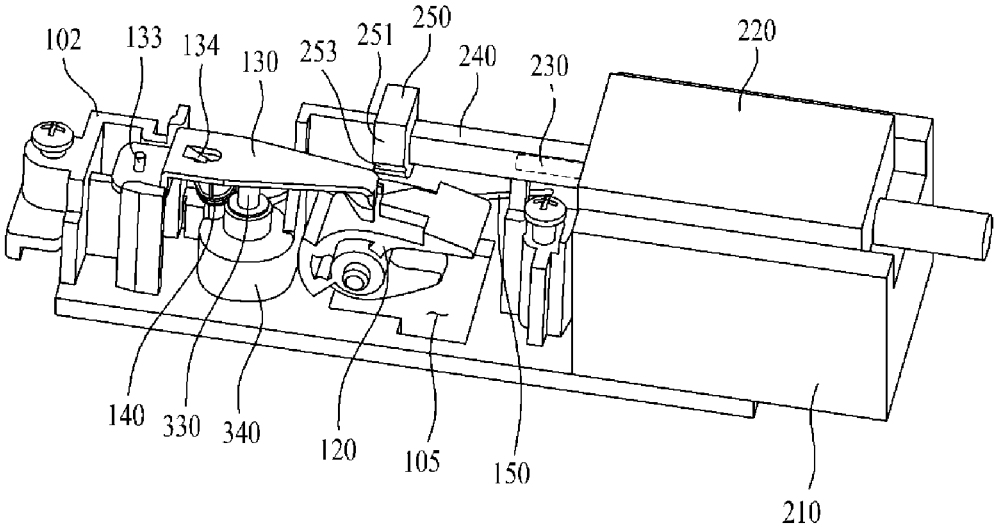
FIG. 8 is a perspective view showing a case of the latch release device of FIG. 6 with a left sidewall of the case omitted for clarity.
Figure 9:
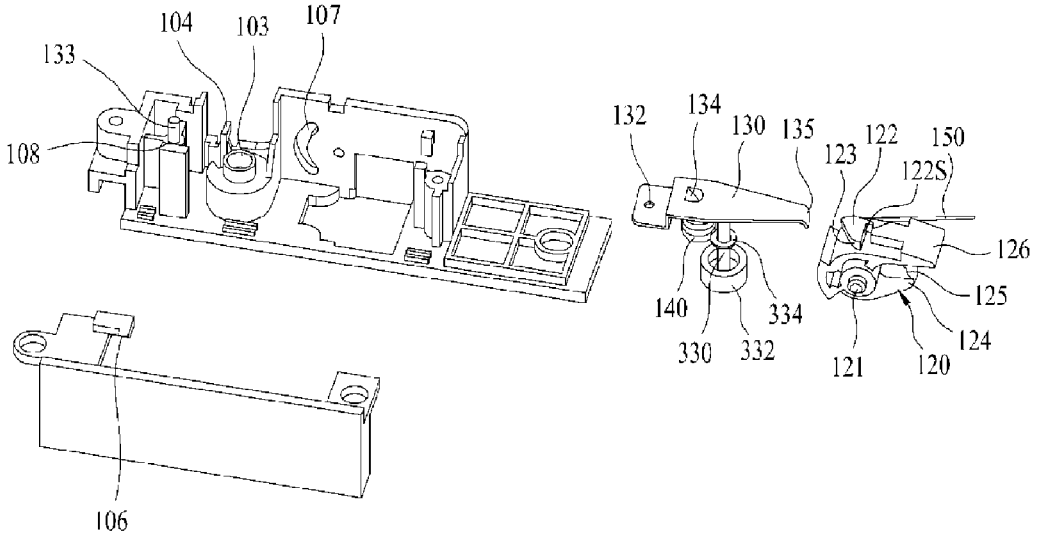
FIG. 9 is an exploded perspective view showing a state in which a latch cam 120 and a stopper 130 are separated from a latch case of FIG. 7.

Referring to FIGS. 8 to 10, the latch rod 330 may be mounted in the latch case 102 of the main door 50 and a rear end of the latch rod 330 may be exposed from a through-hole 108 (see FIG. 5) formed in the front surface of the latch case 102.

To movably mount the latch rod 330 in the latch case 102, as exemplarily illustrated in FIG. 8, a guide boss 340 may be integrally formed in the latch case 102 and configured to receive a front portion of the latch rod 330 therein so as to guide movement of the latch rod 330. The guide boss 340 may take the form of a stepped cylinder including a front portion and a rear portion having a smaller inner diameter than the front portion.

Referring to FIG. 9, the latch rod 330 may be provided at the front portion thereof with a large diameter portion configured to be inserted into the rear portion of the guide boss 340.

The large diameter portion 332 of the latch rod 330 may be integrally formed with the latch rod 330. When the latch rod 330 is pushed, the large diameter portion 332 is caught by a stepped surface of the guide boss 340 to limit the maximum movement distance of the latch rod 330.

In addition, the latch rod 330 may be provided at a rear portion thereof with a groove formed in an outer circumferential surface thereof, and a 'C'-shaped stopper ring 334 may be fitted into the groove.

The latch rod 330 is inserted into the guide boss 340 such that a rear end portion of the latch rod 330 protrudes from the guide boss 340 by a prescribed length. The stopper ring 334 is located at the protruding portion of the latch rod 330, thereby serving to prevent the latch rod 330 from being separated from the guide boss 340.

As exemplarily illustrated in FIG. 9, the guide boss 340 has a through-hole 103 formed in a rear surface thereof. The through-hole 103 has a diameter corresponding to a diameter of the latch rod 330 and serves to guide sliding movement of the latch rod 330.

The latch device 100 may further include the first elastic member 140 that is connected to the stopper 130 to apply force for rotating the stopper 130 in a direction crossing a movement direction of the latch rod 330. The first elastic member 140 may be a tensile spring connected between the stopper 130 and one side of the latch case 102.

As exemplarily illustrated in FIGS. 8 and 9, a loop 134 may be formed at the middle of the stopper 130 such that one end of the first elastic member 140 is caught by the loop 134. The loop 134 may be formed by partially punching a middle portion of the stopper 130 formed of a metal and bending the partially punched portion about a left end thereof.

In addition, a loop 104 may be formed at one side of the latch case 102 such that the other end of the first elastic member 140 is caught by the loop 104. The loop 104 may be shaped to extend forward from the right side of the latch case 102 and be bent outward.

The first elastic member 140 is obliquely mounted between the two loops 134 and 104 to apply elastic force for pulling the stopper 130 rearward and rightward relative to the pivot shaft 133. In this way, the first elastic member 140 may cause the stopper 130 to return to an original position thereof when the stopper 130 is pivoted upward and downward by the latch rod 330 as well as when the stopper 130 is pivoted leftward and rightward by the head member 250.

Figure 6:
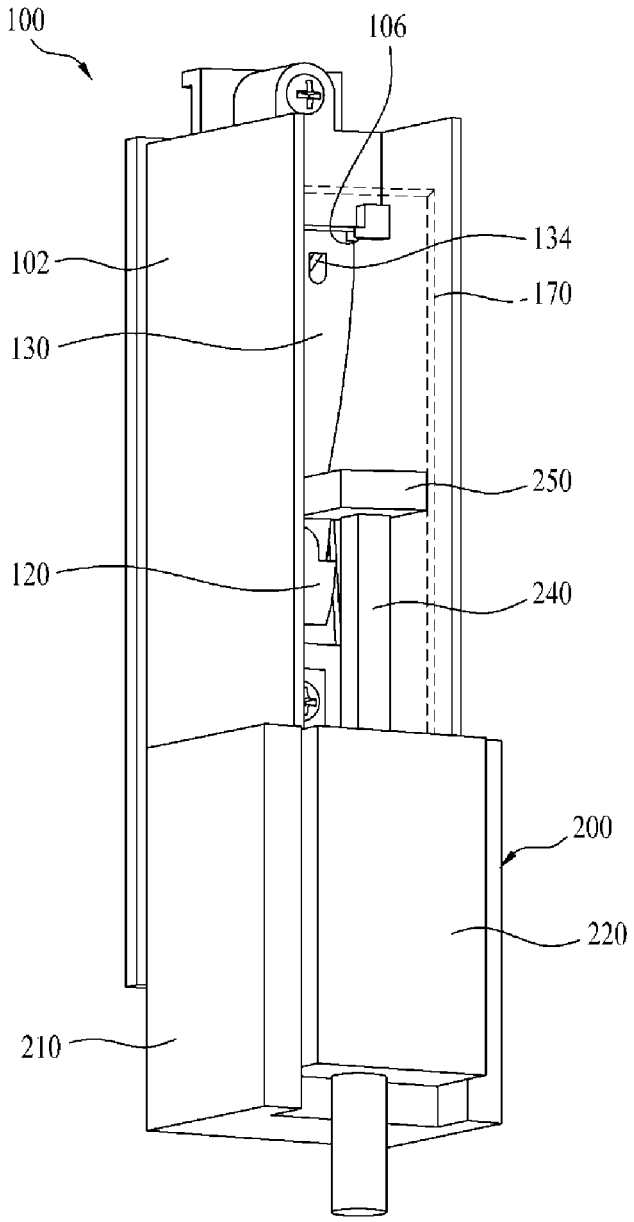
FIG. 6 is a perspective view showing an example latch release device according to the present application.

In addition, as exemplarily illustrated in FIGS. 6 and 9, an inclined guide piece 106 may protrude from one side of an upper surface of the latch case 102. The inclined guide piece 106 serves to support and guide a lateral surface of the stopper 130 in order to prevent the stopper 130 from being tilted rightward by the first elastic member 140 when the stopper 130 is pivoted upward and downward by the latch rod 330.

In consideration of the fact that the stopper 130 is pulled by the first elastic member 140 so as to be tilted rearward and rightward, the inclined guide piece 106 may be formed at the right side of the upper surface of the latch case 102 so as to selectively come into contact with a right lateral surface of an upper portion of the stopper 130.

The latch case 102, as exemplarily illustrated in FIG. 9, is dividable into left and right sections, which may provide assembly convenience when, for example, the latch cam 120 and the stopper 130 are mounted into the latch case 102. At this time, the inclined guide piece 106 may protrude rightward from the left side of the latch case 102.

In addition, the latch cam 120 is mounted to a rotating shaft 121 and in turn the rotating shaft 121 is mounted in the latch case 120 so as to extend in a left-and-right direction. A second elastic member 150 is mounted to one end of the rotating shaft 121 to apply force for rotating the latch cam 120 when the latch cam 120 is unlocked from the stopper 130.

A direction in which the latch cam 120 is rotated by the second elastic member 150 is a direction in which the latch cam 120 is released from the hook member 110. The second elastic member 150 may be a torsion spring mounted to the rotating shaft 121 of the latch cam 120.

The latch cam 120 may have a recess into which one end of the torsion spring 150 is inserted and a catch piece may protrude from an inner surface of the latch case 102 such that the other end of the torsion spring 150 is caught by the catch piece.

In addition, as exemplarily illustrated in FIG. 9, an arc-shaped guide groove 107 may be formed in a lateral surface of the latch case 102 to limit a pivotal rotation angle of the latch cam 120.

In addition, an insert piece may be formed at one side of the latch cam 120. The insert piece may be inserted into and guided by the guide groove 107 to limit a pivotal rotation angle of the latch cam 120.

The stopper 130 functions to prevent rotation of the latch cam 120 despite torque of the torsion spring 150 in a locked state of the latch cam 120. The latch cam 120 is rotated by the torsion spring 150 when released from a locked state and stops rotation when the insert piece of the latch cam 120 is supported by one end of the guide groove 107.

Descriptions will now be given of an operation to release locking between the stopper 130 and the latch cam 120 by the latch rod 330 with reference to FIG. 10.

Figure 10A:
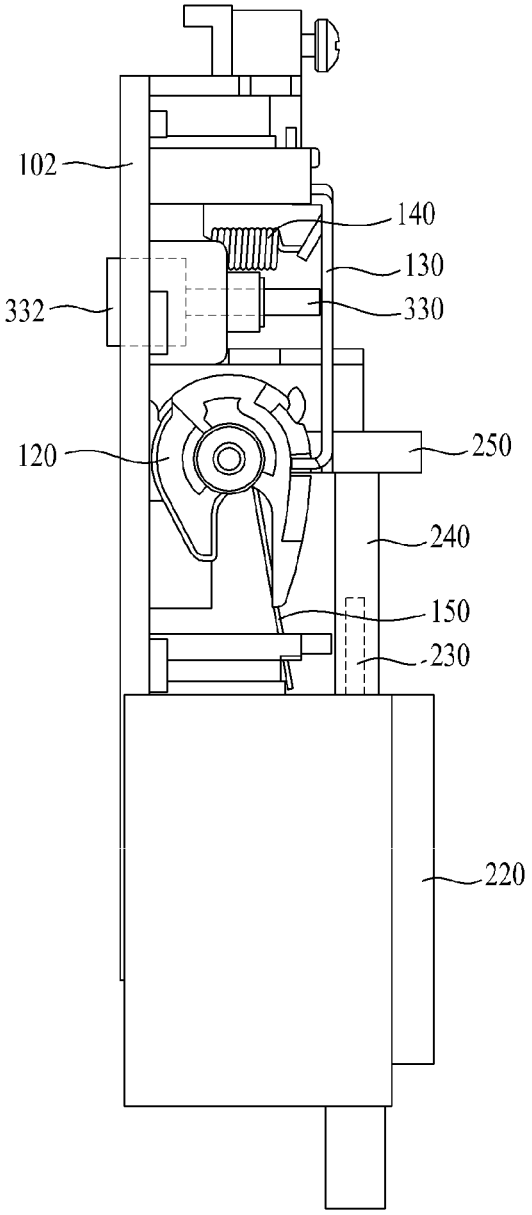
FIGS. 10A and 10B are side sectional views showing an example mechanical operation of the latch release device.

As exemplarily illustrated in FIG. 10A, the latch cam 120 cannot be pivoted despite elasticity of the second elastic member 150 in a state in which the stopper 130 is caught by the latch cam 120.

Figure 10B:
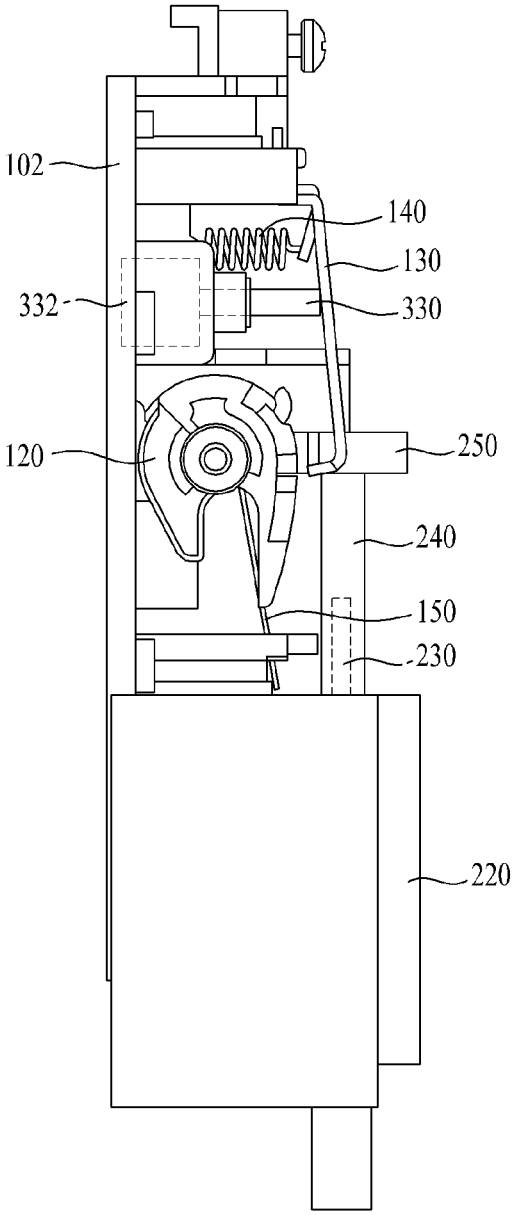

As exemplarily illustrated in FIG. 10B, when the latch rod 330 pushes the stopper 130, the bent end 135 of the stopper 130 is separated from the latching protrusion 122 of the latch cam 120, thus causing the latch cam 120 to be pivotally rotatable by the torsion spring 150.

Accordingly, as the latch cam 120 is pivoted by a prescribed angle, the hook member 110 (FIG. 5) caught by the latch cam 120 is separable from the latch cam 120.

As exemplarily illustrated in FIGS. 6 to 8, the latch cam 120, the stopper 130, the first elastic member 140, and the second elastic member 150 are mounted in the latch case 102. The latch case 102 may further include a cover member 170 formed of an elastic member to allow rearward pivotal rotation of the stopper 130.

The cover member 170 may be formed of silicone gel to elastically support the latch cam 120 when the latch cam 120 is pushed and lifted by the latch rod 330. The cover member 170 is upwardly spaced apart from the head member 250 to vertically movably support the head member 250.

In addition, as exemplarily illustrated in FIG. 7, after the latch device and the solenoid device are assembled with the latch case 102, a case cover 270 may enclose the resulting assembly to protect the same. The case cover 270 may be formed of a plastic material, like the latch case 102, and may take the form of a cuboid internally defining a receiving space and having open top and front sides. The case cover 270 may prevent a foaming agent from entering the latch case 102 when the foaming agent is injected into the main door 50.

The solenoid device 200 requires connection of electric wires. Thus, the case cover 270 may have at least one hole for connection of the electric wires.

The controller 260 (FIG. 3), which is used to operate the solenoid device 200, may be electronically operated based on sensing of a user touch, access, or voice, other than being a mechanically operated button. The controller 260 may be a touch sensor device that is operated by user touch. The touch sensor device may recognize a user operation command via sensing of variable current depending on user touch.

As shown in FIG. 3, a front panel as an exterior material may be attached to the front surface of the sub door 60. The controller 260 may be mounted at the back of the front panel such that a user touch signal is transmitted to the controller 260 through the front panel.

As shown, the operating button 310 is exposed through a hole formed in the front panel, whereas the controller 260 may be covered with and buried below the front panel so as not to be exposed from the front panel.

In some cases, the controller 260 may be a voice recognition device that is operated by user voice. The voice recognition device may also be mounted at the back of the front panel attached to the sub door 60. The voice recognition device may recognize a user voice command and determine whether the recognized voice command is a command to release the latch device 100.

For example, the user may preset a voice command "open the sub door" as a latch device release command in the controller 260. Accordingly, when the user says "open the sub door" near the refrigerator, the voice recognition device may operate the solenoid device 200 to release a locked state of the latch device 100 to enable opening of the sub door 60.

Figure 11A:
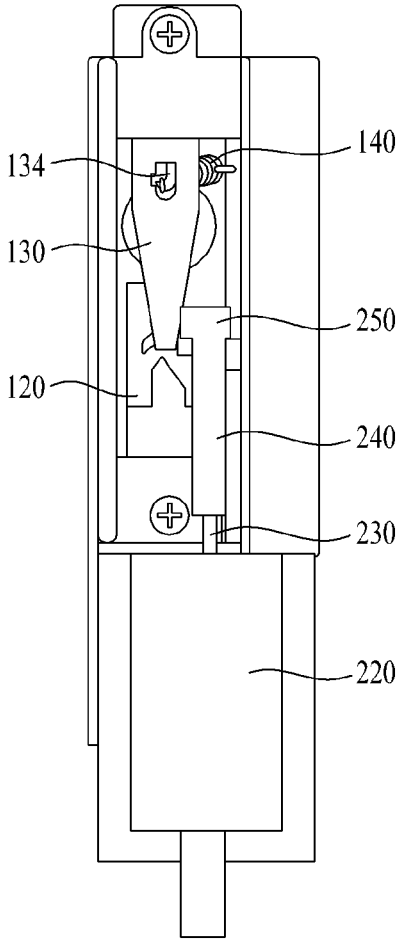
FIG. 11A-C are front views showing an example electronic operation of the latch release device.

FIG. 11A illustrates a state before the solenoid device 200 is operated.

Figure 11B:
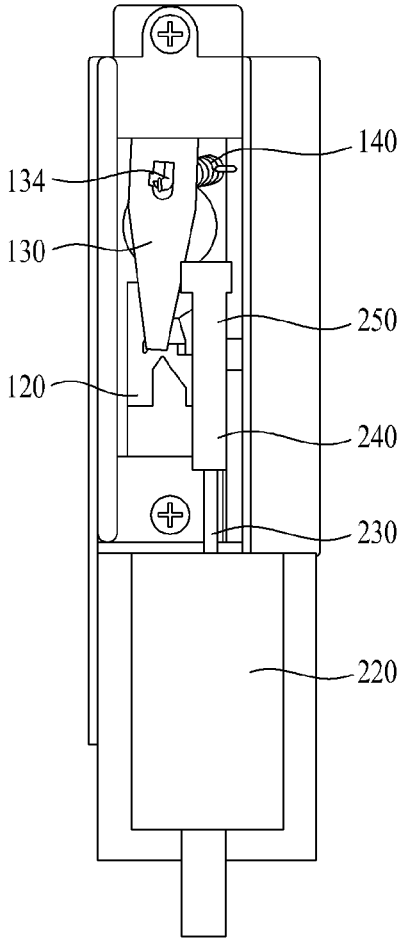

When the user operates the controller 260, as exemplarily illustrated in FIG. 11B, the head member 250 of the solenoid device 200 is moved upward to push the stopper 130, thus causing the stopper 130 to be pivoted leftward. At this time, the bent end 135 of the stopper 130 is moved leftward from the latching protrusion 122 of the latch cam 120.

Figure 11C:
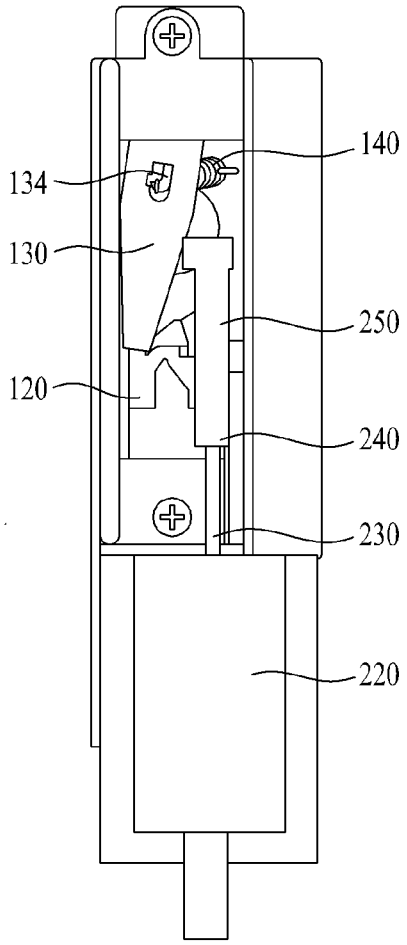

As exemplarily illustrated in FIG. 11C, once the head member 250 of the solenoid device 200 was moved upward to the maximum extent, the bent end 135 of the stopper 130 is completely separated leftward from the latching protrusion 122 of the latch cam 120, thereby enabling pivotal rotation of the latch cam 120. As a result, the torsion spring 150 pivotally rotates the latch cam 120, thus causing to hook member 110 caught by the latch cam 120 to be separable from the latch cam 120.

Figure 12:
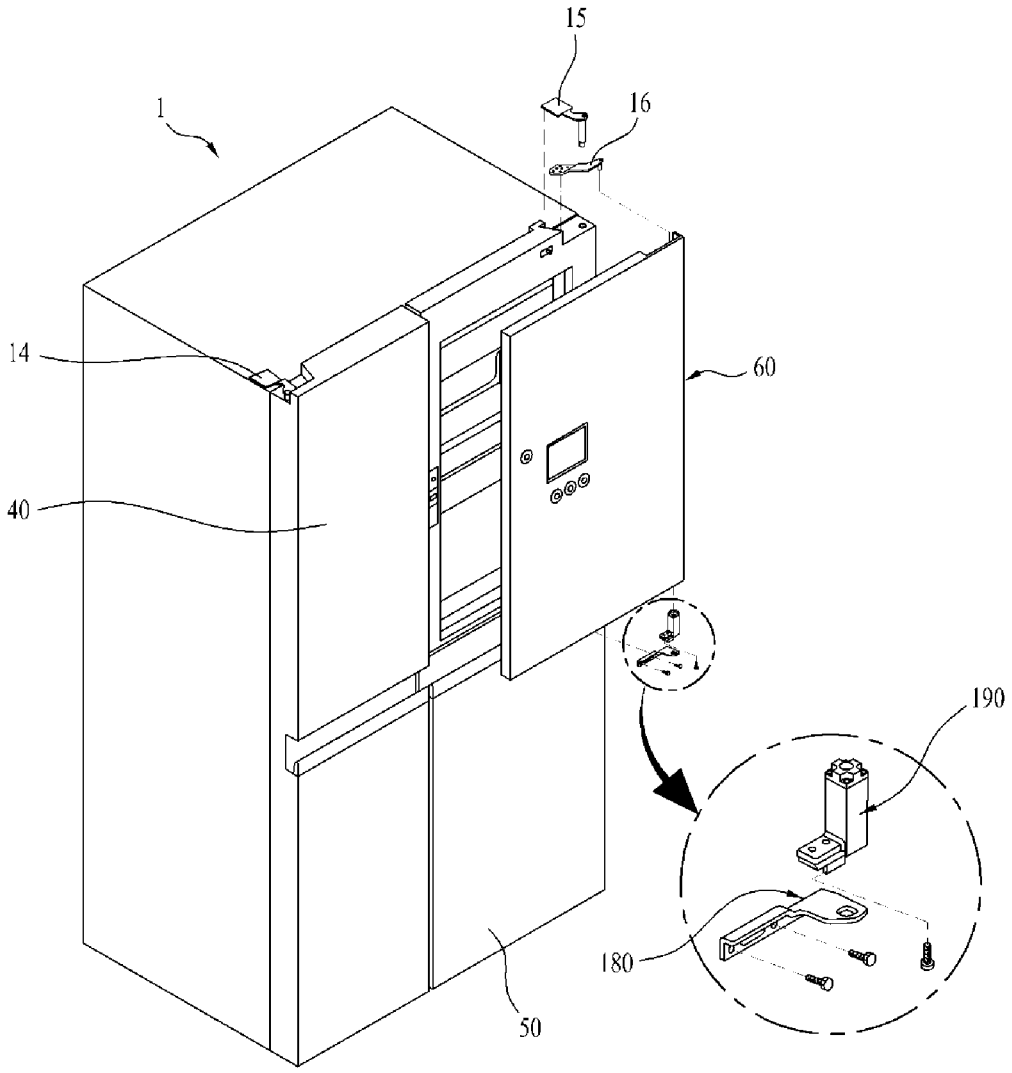
FIG. 12 is a perspective view showing the coupling of a hinge assembly and a hinge bracket to a sub door.

Meanwhile, as exemplarily illustrated in FIG. 12, the refrigerator of the present application may further include a hinge bracket 180 to pivotally couple one end of the sub door 60 to the main door 50, and a hinge assembly 190 to pivotally connect the end of the sub door 60 to the hinge bracket 180, the hinge assembly 190 applying elastic force in an opening direction of the sub door 60.

The hinge bracket 180 is coupled to a lower end of the sub door 60 and pivotally supports the sub door 60 relative to the main door 50 in cooperation with the second hinge 16 coupled to the upper end of the sub door 60.

The hinge assembly 190 allows the sub door 60 to be automatically opened by a prescribed angle when the user operates the sub door 60 to open the same and prevents excessive opening of the sub door 60 after the sub door 60 was opened by the prescribed angle.

Figure 13:
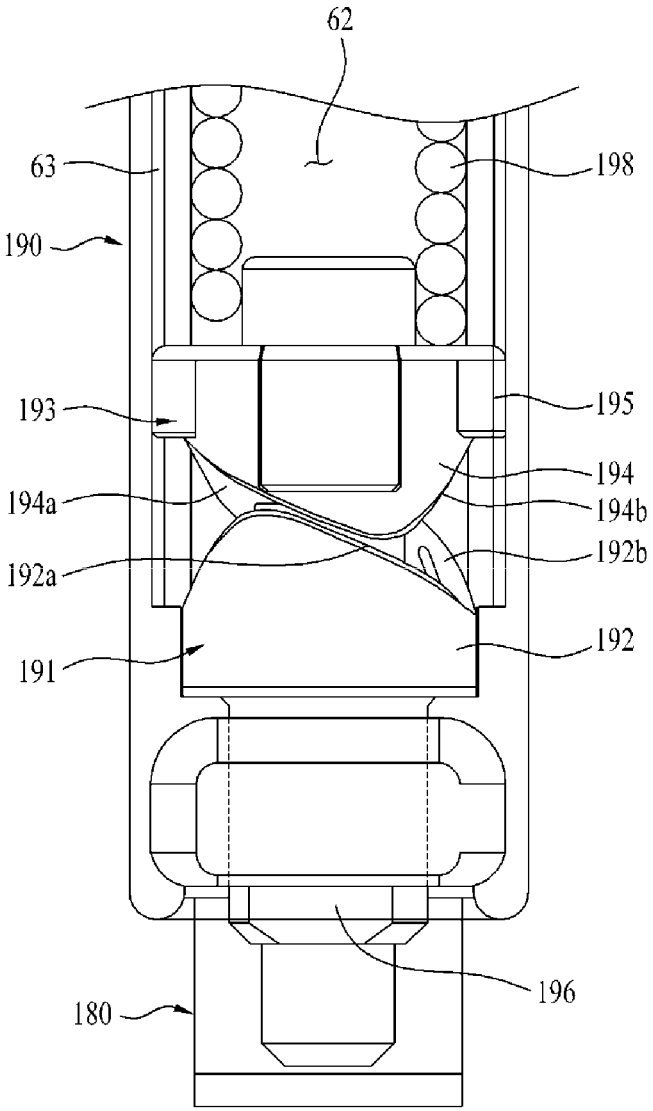
FIG. 13 is a sectional view showing an example operation of the hinge assembly and the hinge bracket when the sub door is closed.
Figure 14:
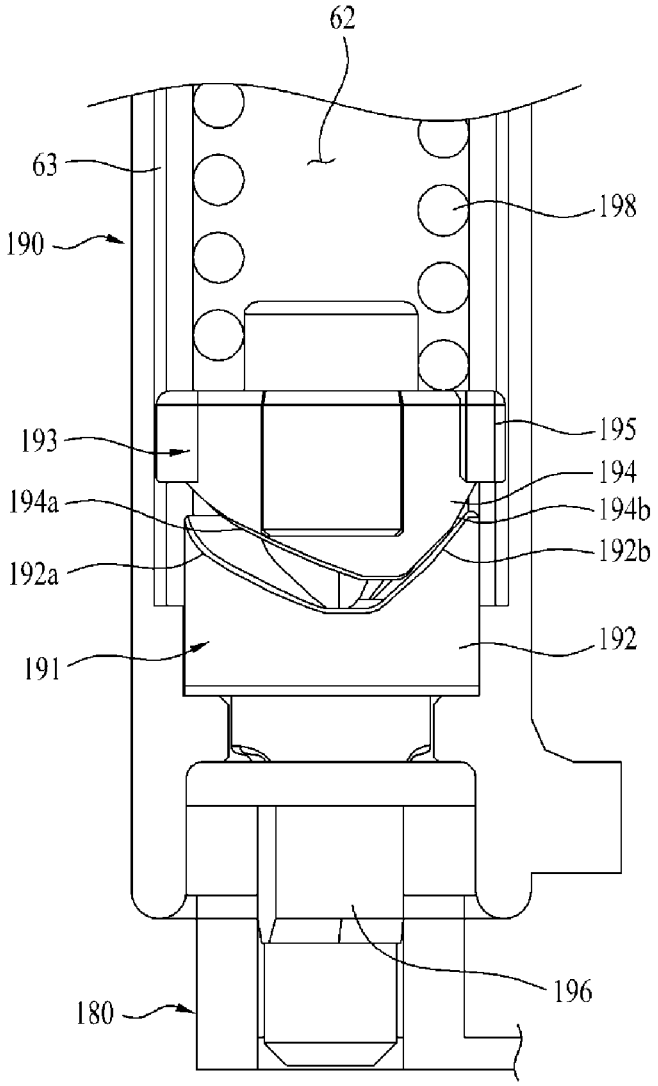
FIG. 14 is a sectional view showing an example operation of the hinge assembly and the hinge bracket when the sub door is opened.

As exemplarily illustrated in FIGS. 13 and 14, the hinge assembly 190 may include a hinge fixing portion 191 fixed to the hinge bracket 180 and provided at an upper surface thereof with a first cam 192, a hinge rotating portion 193 formed at the sub door 60 and provided at a lower surface thereof with a second cam 194 configured to be engaged with the first cam 192, and an elastic member 198 mounted at one side of the hinge rotating portion 193 to provide elastic force required to push the hinge rotating portion 193 to the hinge fixing portion 191.

The hinge fixing portion 191 may include an insertion protruding portion 196 fixed to the hinge bracket 180 and the first cam 192 located at the top of the insertion protruding portion 196. The hinge fixing portion 191 is fixed to the hinge bracket 180 and not affected by rotation of the sub door 60.

An upper surface of the first cam 192 consists of a first cam surface 192*a* inclined downwardly from one side of the first cam 192 and a second cam surface 192*b* inclined upward from a lower end of the first cam surface 192*a*. The first cam surface 192*a* and the second cam surface 192*b* may be consecutively formed. That is, two cam surfaces may be consecutively formed along the periphery of the upper surface of the first cam 192.

A fixing protruding portion 195 may be formed at the periphery of the hinge rotating portion 193. A hinge receiving region 62 may be defined in the sub door 60 and the hinge rotating portion 193 may be mounted in the hinge receiving region 62.

A protruding portion receiving groove 63 may be indented in an inner circumferential surface of the hinge receiving region 62 and the fixing protruding portion 195 may be received in the protruding portion receiving groove 63. Accordingly, the hinge rotating portion 193 is rotatable along with the sub door 60.

The second cam 194 is formed at the lower surface of the hinge rotating portion 193. A lower surface of the second cam 194 consists of a third cam surface 194*a* inclined downward from one side of the second cam 194 and a fourth cam surface 194*b* inclined upward from a lower end of the third cam surface 194*a*.

The third cam surface 194*a* and the fourth cam surface 194*b* may be consecutively formed. That is, two cam surfaces may be consecutively formed along the periphery of the lower surface of the second cam 194. The third cam surface 194*a* and the fourth cam surface 194*b* respectively come into contact with the first cam surface 192*a* and the second cam surface 192*b*. To this end, the third cam surface 194*a* and the fourth cam surface 194*b* may be shaped to correspond to the first cam surface 192*a* and the second cam surface 192*b* respectively.

An upper surface of the hinge rotating portion 193 may be supported by an elastic member 198 such as a spring installed in the hinge receiving region 62. As a result, the lower surface of the hinge rotating portion 193 may continuously come into contact with the upper surface of the hinge fixing portion 191, and the first cam surface 192*a* and the second cam surface 192*b* of the hinge fixing portion 191 are moved while coming into contact with the third cam surface 194*a* and the fourth cam surface 194*b* of the hinge rotating portion 193 according to rotation of the sub door 60.

For example, even in a closed state of the sub door 60, as exemplarily illustrated in FIG. 13, the first cam surface 192*a* and the third cam surface 194*a* come into contact with each other. Both the first cam surface 192*a* and the third cam surface 194*a* are inclined downward from one side of the respective cams 192 and 194. As such, which locking of the sub door 60 is released, the third cam surface 194*a* slides downward on the first cam surface 192*a* by the weight of the sub door 60. In this way, the sub door 60 is automatically rotated without application of torque to the sub door 60.

Upon opening of the sub door 60, once the sub door 60 has been pivoted by a prescribed angle or more, the first cam surface 192*a* and the third cam surface 194*a* no longer come into contact with each other, and the second cam surface 192*b* and the fourth cam surface 194*b* come into contact with each other. As exemplarily illustrated in FIG. 14, the rotation speed of the sub door 60 is gradually reduced because both the second cam surface 192*b* and the fourth cam surface 194*b* are inclined upward from the lower ends of the first and third cam surfaces 192*a* and 194*a*.

Once the sub door 60 has been pivoted by a prescribed angle, for example, 140 degrees, the second cam surface 192*b* and the fourth cam surface 194*b* completely come into contact with each other as exemplarily illustrated in FIG. 14. In addition, the elastic member 198 is compressed and the hinge rotating portion 193 is no longer movable upward. In such a state, pivotal rotation of the sub door 60 stops and is limited.

The maximum opening angle of the sub door 60 may be determined according to, for example, the curvatures of the second cam surface 192*b* and the fourth cam surface 194*b* and elasticity of the elastic member 198.

Hereinafter, operation of the sub door 60 of the refrigerator according to the implementation of the present application will be described.

When the user pushes the operating button 310 or operates the controller 260 in a closed state of the sub door 60, the hook member 110 is released from the latch device 100, thus enabling opening of the sub door 60.

Simultaneously, the sub door 60 is automatically opened to a prescribed angle via operation of the hinge assembly 190. The hinge assembly 190 causes the rotation speed of the sub door 60 to be gradually reduced until the sub door 60 is opened to the maximum angle and finally causes the sub door 60 to stop rotation.

As described above, the refrigerator of the present application may selectively release a locked state of the latch device 100 in a mechanical manner or in an electronic manner.

In addition, in the case in which the controller 260 of the latch release device includes a voice recognition device and the sub door 60 is provided with the hinge assembly 190 including the cams and the elastic members, the sub door 60 may be automatically opened without operation of the user, which provides improved use convenience of the refrigerator.

As is apparent from the above description, the refrigerator of the present application has the effect of selectively releasing coupling between a main door and a sub door via user operation or in an automated manner.

Further, a latch release device including a mechanical operating mechanism and an electronic operating mechanism is efficiently received in a defined space, which has the effect of enhancing operation reliability.

Furthermore, an electronic latch release device may be installed alone to ensure efficient arrangement of constituent elements while considerably reducing the thickness of a latch device.

In addition, as a result of providing a voice recognition device that serves as a controller to operate a latch release device and providing a sub door with a hinge assembly including cams and elastic members, the sub door may be automatically opened without operation of the user, which provides improved use convenience of the refrigerator.

Although the exemplary implementations have been illustrated and described as above, of course, it will be apparent to those skilled in the art that the implementations are provided to assist understanding of the present application and the present application is not limited to the above described particular implementations, and various modifications and variations can be made in the present application without departing from the spirit or scope of the present application, and the modifications and variations should not be understood individually from the viewpoint or scope of the present application.

What is claimed is:

1. A refrigerator comprising:

a cabinet;

a storage compartment defined within the cabinet;

a main door pivotally mounted to the cabinet and configured to open or close at least a portion of the storage compartment;

an auxiliary storage compartment mounted to a rear surface of the main door, the auxiliary storage compartment being configured to be accessed through an opening in the main door;

a sub door pivotally mounted to the main door and configured to open or close at least a portion of the opening leading to the auxiliary storage compartment;

a hook member provided at the sub door;

a latch cam pivotally mounted in the main door and configured to be selectively caught by the hook member;

a stopper pivotally mounted at a location above the latch cam and configured to selectively limit pivotal rotation of the latch cam;

an operating button provided at the sub door and configured to be pushed by a user;

a push rod located at a rear side of the operating button and configured to be horizontally moved along with the operating button;

a latch rod mounted in the main door and configured to push the stopper in a rearward direction by being horizontally moved by the push rod;

a solenoid device mounted below the latch cam and configured to laterally push the stopper via a vertical movement caused by the solenoid device to pivotally rotate the stopper about an axis extending in the rearward direction to thereby release locking between the stopper and the latch cam; and a controller provided at the sub door to selectively operate the solenoid device.

2. The refrigerator according to claim 1, wherein the solenoid device includes:

a main body configured to be operated via application of electric power;

a rod mounted to the main body and configured to move in a vertical direction; and a head member coupled to an end of the rod and configured to selectively push a lateral surface of the stopper.

3. The refrigerator according to claim 2, wherein the rod and head member are configured, based on being upwardly moved, to be lowered by weights thereof to return to original positions thereof when electric power is interrupted after operation of the solenoid device.

4. The refrigerator according to claim 2, wherein:

the stopper has at least one inclined lateral surface; and the head member includes a groove configured to laterally push the stopper while moving upward in contact with the inclined lateral surface of the stopper.

5. The refrigerator according to claim 1, wherein the latch cam includes:

a latching protrusion formed at an outer circumferential surface of the latch cam and configured to be caught by a bent end of the stopper; and a lateral support portion protruding from a lateral end of the latching protrusion and configured to support a lateral surface of the latching protrusion.

6. The refrigerator according to claim 5, wherein the latch cam has an open side opposite to the lateral support portion such that the stopper is configured to be released from the latching protrusion by being pivoted based on the head member laterally pushing the stopper.

7. The refrigerator according to claim 6, wherein the latch cam further includes a slope configured to guide the bent end of the stopper so as to allow the bent end to be caught by the latching protrusion based on the latch cam that has been released from the stopper again being locked with the stopper.

8. The refrigerator according to claim 1, further comprising a first elastic member connected to the stopper and configured to apply force for restricting rotation of the stopper about the axis.

9. The refrigerator according to claim 8, further comprising a second elastic member connected to the latch cam and configured to apply force for rotating the latch cam based on the latch cam being released from the stopper.

10. The refrigerator according to claim 9, wherein the second elastic member is a torsion spring mounted to a rotating shaft of the latch cam.

11. The refrigerator according to claim 9, wherein the latch cam, the stopper, the first elastic member, and the second elastic member are mounted in a latch case.

12. The refrigerator according to claim 11, wherein the latch case is provided with an elastic cover member that is configured to allow rearward pivotal rotation of the stopper.

13. The refrigerator according to claim 1, wherein the controller is a touch sensor device configured to be operated by user touch.

14. The refrigerator according to claim 1, wherein the controller is a voice recognition device configured to be operated by user voice.

15. The refrigerator according to claim 1, further comprising:

a hinge bracket configured to pivotally couple one end of the sub door to the main door; and a hinge assembly configured to pivotally connect one end of the sub door to the hinge bracket, the hinge assembly being configured to apply elastic force in an opening direction of the sub door.

16. The refrigerator according to claim 15, wherein the hinge assembly includes:

a hinge fixing portion fixed to the hinge bracket, the hinge fixing portion having a first cam at an upper surface thereof;

a hinge rotating portion at the sub door, the hinge rotating portion having a second cam at a lower surface thereof, the second cam being engaged with the first cam; and an elastic member mounted to one side of the hinge rotating portion to provide elastic force for pushing the hinge rotating portion to the hinge fixing portion.

17. The refrigerator according to claim 1, wherein the stopper is configured, based on the solenoid device moving upward, to be pivotally rotated about the axis from an original position in a first direction, and wherein the stopper is configured, based on the solenoid device moving downward, to return to the original position by being pivotally rotated in a second direction opposite the first direction.

18. The refrigerator according to claim 8, wherein the first electric member is configured, based on the latch rod pushing the stopper in the rearward direction, to apply a pulling force on the stopper for restricting horizontal movement of the stopper in the rearward direction, and wherein the first electric member is configured, based on the solenoid laterally pushing the stopper via the vertical movement, to apply a rotational force on the stopper for restricting rotation of the stopper about the axis.

* * * * *